US005334990A

United States Patent [19]

Robinson

[11] Patent Number: 5,334,990

[45] Date of Patent: Aug. 2, 1994

[54] KU-BAND SATELLITE DISH ANTENNA

[75] Inventor: James E. Robinson, Littleton, Colo.

[73] Assignee: K-Star International Corp., Sedalia, Colo.

[21] Appl. No.: 24,910

[22] Filed: Mar. 2, 1993

Related U.S. Application Data

[63] Continuation of Ser. No. 879,051, Apr. 30, 1992, abandoned, which is a continuation of Ser. No. 700,097, May 7, 1991, abandoned, which is a continuation of Ser. No. 499,061, Mar. 26, 1990, abandoned.

[51] Int. Cl.[5] ..... H01Q 1/12; H01Q 15/16; H01Q 19/10; H01Q 19/12

[52] U.S. Cl. ..... 343/840; 343/880; 343/883; 343/914

[58] Field of Search ..... 248/185, 676; 343/878, 343/880, 883, 914, 915, 916, 882, 781 R, 781 P, 840; H01Q 15/02, 15/14, 15/20, 1/08, 1/10, 1/12, 19/14, 3/00–3/08

[56] References Cited

U.S. PATENT DOCUMENTS

| | | | |
|---|---|---|---|
| 1,906,546 | 5/1933 | Darbord | 343/840 |
| 3,832,717 | 8/1974 | Taggart, Jr. | 343/915 |
| 4,783,662 | 11/1988 | Wirth, Jr. et al. | 343/882 |
| 4,825,223 | 4/1989 | Moore | 343/914 |

FOREIGN PATENT DOCUMENTS

| | | | |
|---|---|---|---|
| 0112004 | 8/1980 | Japan | 343/882 |
| 0073506 | 5/1982 | Japan | 343/914 |
| 0014506 | 1/1985 | Japan | 343/878 |
| 0178706 | 9/1985 | Japan | 343/915 |
| 0173804 | 7/1987 | Japan | 343/914 |
| 0254009 | 10/1989 | Japan | H01Q 15/140 |
| 2188166 | 9/1987 | United Kingdom | 343/914 |

*Primary Examiner*—Rolf Hille
*Assistant Examiner*—Peter Toby Brown
*Attorney, Agent, or Firm*—William E. Hein

[57] ABSTRACT

A compact, portable satellite dish antenna system comprises a dish-shaped member having an inner surface that includes a central circular flat area and a plurality of annular parabolically-shaped segments concentric with the central circular flat area for providing a plurality of focal points over the inner surface of the dish-shaped member to thereby improve the signal gathering characteristics of the dish antenna system.

4 Claims, 3 Drawing Sheets

FIG. 4
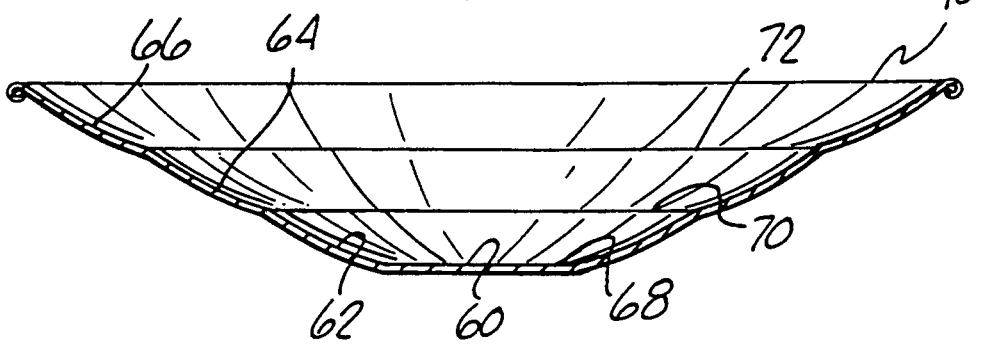
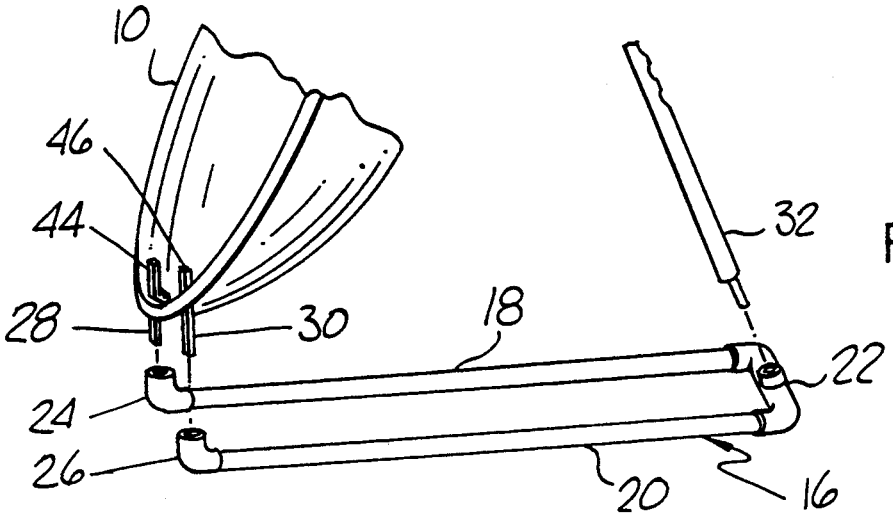
FIG. 5
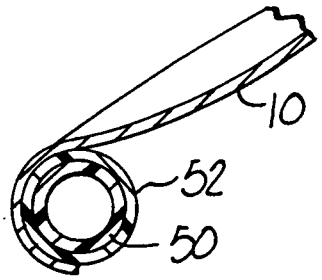
FIG. 7
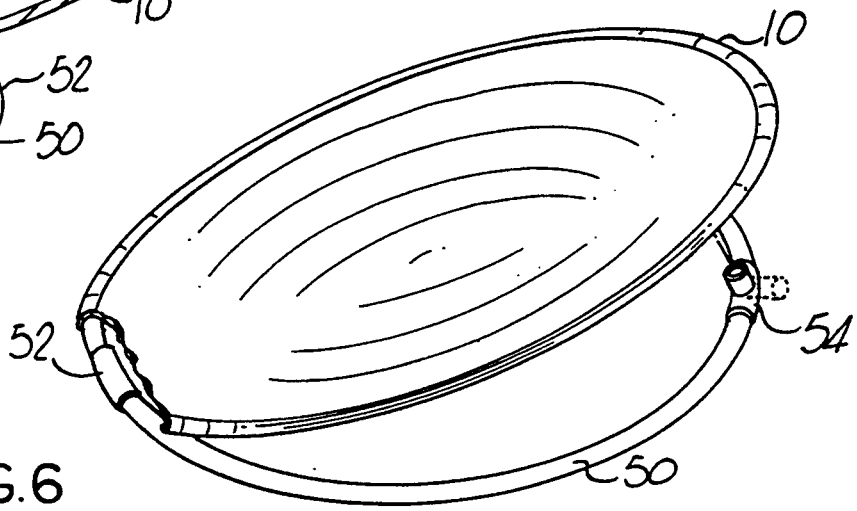
FIG. 6

KU-BAND SATELLITE DISH ANTENNA

REFERENCE TO RELATED APPLICATIONS

This application is a continuation of Ser. No. 07/879,051, filed Apr. 30, 1992, and now abandoned, which is a continuation of Ser. No. 07/700,097 filed May 7, 1991, and now abandoned, which is a continuation of Ser. No. 07/499,061 filed Mar. 26, 1990, and now abandoned.

BACKGROUND AND SUMMARY OF THE INVENTION

This invention relates generally to satellite dish antennas and more particularly to an improved portable satellite dish antenna for receiving Ku-band, or direct broadcast, satellite signals carrying audio, video, or computer data information. Prior art satellite dish antennas for receiving C-band satellite television signals are typically at least eight feet in diameter and are therefore large, bulky, expensive, and generally unattractive structures that are permanently mounted using base posts set in the ground. Even prior art Ku-band satellite dish antennas involve bulky support arrangements that significantly reduce their portability. In addition, the signal reception characteristics of these known Ku-band satellite dish antennas suffer due to their susceptibility to noise resulting from a uniform parabolic dish shape.

It is therefore a principal object of the present invention to provide a compact, portable satellite dish antenna that can be easily assembled and disassembled for location either outdoors or indoors adjacent the user's television receiver or computer and that exhibits improved reception of Ku-band signals. This and other objects are accomplished in accordance with the illustrated preferred embodiments of the present invention by providing a satellite dish antenna having an inner or working surface formed to have a central flat area and a series of annular, separate parabolically-shaped segments that are concentric with the central flat area. A fork-like feed mount and a three-point dish support structure that includes an elevation adjustment facilitate easy assembly and disassembly of the present satellite dish antenna to enhance its portability.

BRIEF DESCRIPTION OF THE DRAWINGS

FIG. 4 is a cross-sectional view of the dish portion of the Ku-band satellite dish antenna system of FIG. 1 illustrating the shape of the inner surface of the dish.

FIG. 5 is a partial assembly diagram of the satellite dish antenna system of FIG. 1 illustrating the way in which the dish and an elevation adjustment member are connected to a base support member.

FIG. 6 is a broken away pictorial diagram of a portion of the Ku-band satellite dish antenna system of FIG. 2 illustrating the way in which a circular support member can be folded behind the dish to enhance its portability.

FIG. 7 is a partial cross-sectional view of the dish of FIGS. 2 and 6 illustrating the way in which the circular Support member engages a rear arcuate lip formed along the periphery of the dish.

DETAILED DESCRIPTION OF THE INVENTION

Figure 1:
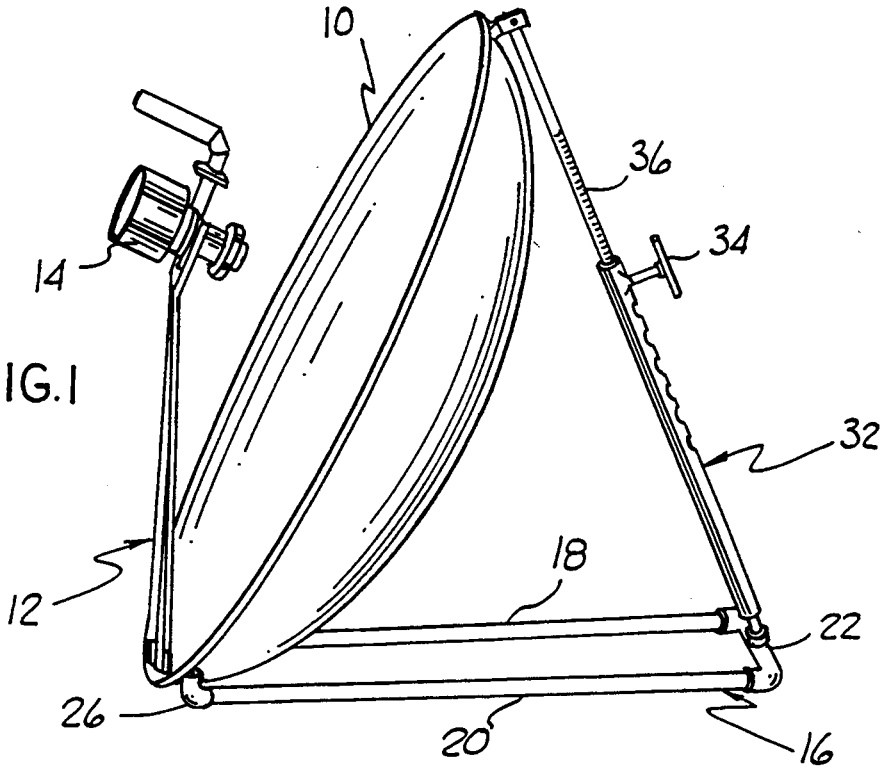
FIG. 1 is a side pictorial diagram of a Ku-band satellite dish antenna system constructed in accordance with a preferred embodiment of the present invention.
Figure 2:
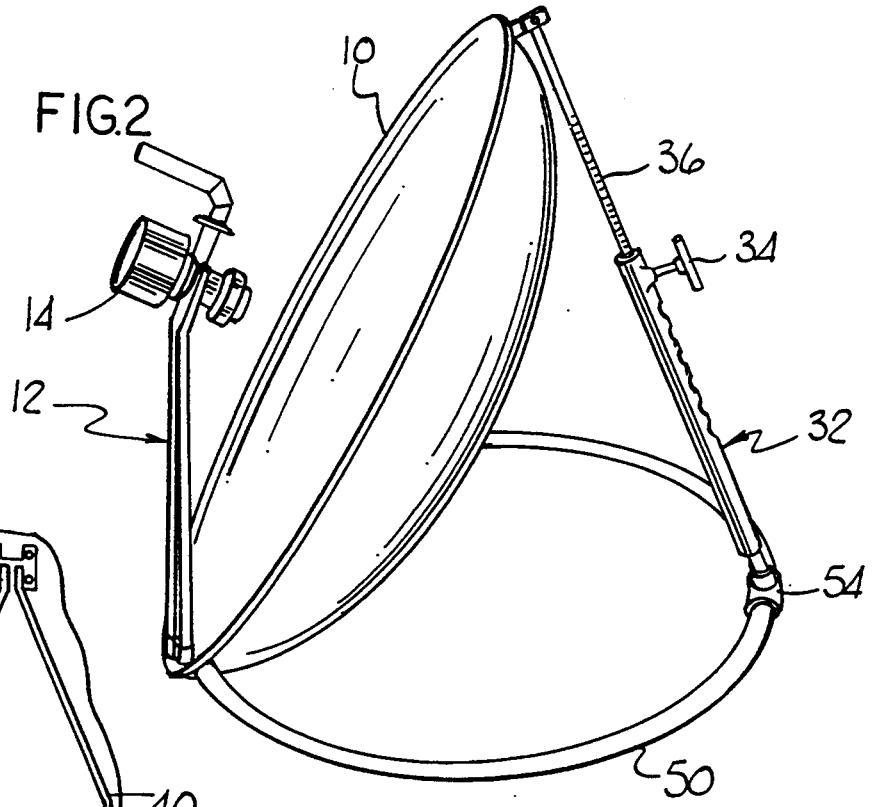
FIG. 2 is a side pictorial diagram of the Ku-band satellite dish antenna system of FIG. 1 in which an alternative support mechanism i s employed.
Figure 3:
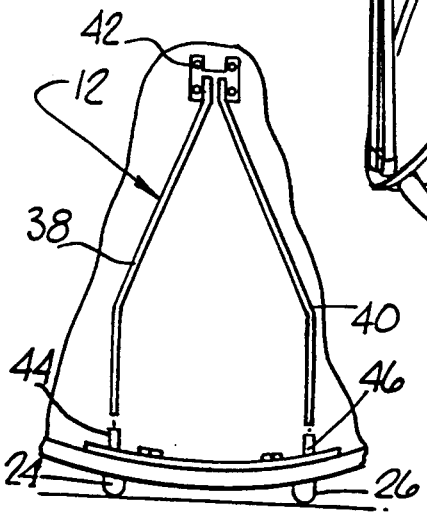
FIG. 3 is a broken away pictorial of the satellite dish antenna system of FIG. 1 illustrating how the forked feed mount is attached to the dish itself.

Referring now to FIGS. 1 and 2, there are shown pictorial diagrams of a satellite dish antenna system constructed in accordance with alternative embodiments of the present invention. Each embodiment includes a dish 10 and a feed mount 12 for supporting a conventional feed horn and amplifier assembly 14. In the embodiment of FIG. 1, dish 10 is supported by a U-shaped base 16 that comprises a pair of rearwardly extending parallel leg members 18, 20 and a cross member 22 connecting parallel leg members 18, 20 at their rearward ends. U-shaped base 16 may be conveniently fabricated using readily available PVC tubing and connecting elements, for example. The use of such material results in a non-penetrating, non-abrasive mounting arrangement for dish 10. As illustrated in greater detail in FIG. 5, the forward ends of parallel leg members 18, 20 are fitted with upwardly projecting right angle elbow members 24, 26 for receiving downwardly projecting legs 28, 30 that are fixedly mounted along the bottom peripheral edge of dish 10. Cross member 22 at the rear of base 16 includes an upwardly projecting T-member for receiving an elevation adjustment assembly 32 that is hingedly attached at the top peripheral edge of dish 10. Elevation adjustment assembly 32 may comprise a telescoping rod whose overall length is fixed by means of a thumbscrew 34. A scale 36 may be provided on one of the telescoping rods comprising elevation adjustment assembly 32 so that the user can adjust the elevation of dish 10 to known angles of elevation corresponding to certain satellite positions. Feed mount 12 is fabricated in the shape of a fork that includes a pair of downwardly projecting legs 38, 40 that converge at their top ends to receive a feed bracket 42 which, in turn, receives a feed horn and amplifier assembly 14. The bottom ends of forks 38, 40 are removably attached to the peripheral edge of dish 10 by means of a pair of receptacles 44, 46 into which forks 38, 40 are inserted.

Figure 8:
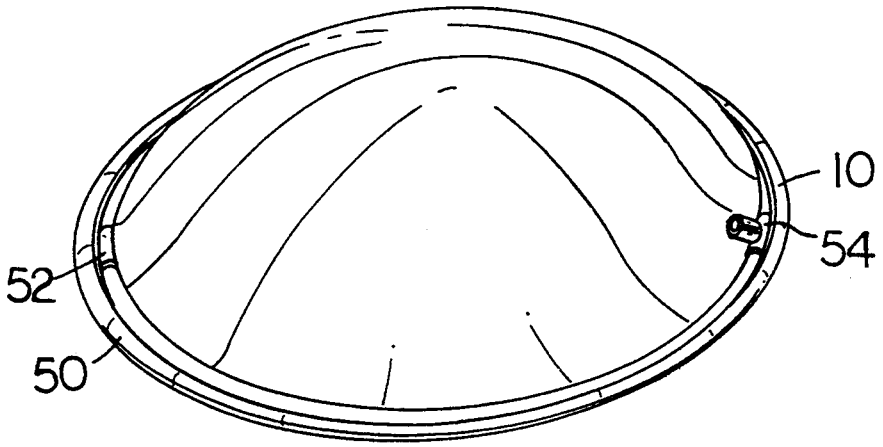
FIG. 8 is a pictorial diagram of the rear or convex surface of the Ku-band satellite dish antenna of FIG. 6 illustrating the way in which the circular support member is completely folded behind the dish in the stowed position.

In the embodiment of FIG. 2, a circular base ring 50 is hingedly attached behind dish 10 along the peripheral edge thereof, as shown in more detail in FIGS. 6–8. Hinged attachement of base ring 50 may be made, for example, by a sleeve 52 fixedly connected behind a peripheral lip area formed along the edge of dish 10. Base ring 50 is then permitted to rotate within sleeve 52 from a stowed position in which base ring 50 resides within the peripheral lip area to an operating position in which dish 10 is rotated upward from base ring 50 to a desired elevation that is then fixed by means of thumbscrew 34 of elevation adjustment assembly 32. Elevation adjustment assembly 32 is removably received by a rotatable T-sleeve 54 over base ring 50 that can be rotated from an upwardly projecting position for receiving elevation adjustment assembly 32 to an outwardly projecting position to permit base ring 50 to be rotated into its stowed position behind dish 10, as illustrated in FIG. 8.

Referring now to FIG. 4, there is Shown a cross section of dish 10 of the Ku-band satellite dish antenna system of FIGS. 1 and 2 shaped in accordance with the present invention. Unlike the prior art dish antennas which have a uniform parabolic working surface, dish 10 is shaped to include a central area 60 whose working surface is formed to be flat. Extending outwardly from central area 60 are three annular segments 62, 64, 66 that are concentric with central area 60 and whose working surfaces are separately parabolically shaped. The annular segments 62, 64, 66 provide circular lines of discontinuity 68, 70, 72 over the working surface of dish 10. In accordance with one set of workable design parameters for dish 10, its overall diameter is 32 inches and its depth is 5.75 inches. The flat central area 60 is approximately 6 inches in diameter and each of the three annular segments 62, 64, 66 is approximately 4.33 inches in width. While FIG. 4 illustrates three annular segments 62, 64, 66, a larger number of such segments could be provided. Alternatively, two such segments could be provided. The use of such annular segments, each of which is separately parabolically shaped, results in a plurality of separate focal points over the working surface of dish 10. This important feature reduces the need for absolutely precise positioning of dish 10 and generally increases its signal gathering capabilities over prior art uniform dish designs.

I claim:

1. A satellite dish antenna system comprising:

a circular dish-shaped member having an inner concave reflecting surface to be focused toward a transmitting earth satellite, the inner concave reflecting surface of said circular dish-shaped member having a central circular planar area and a plurality of annular parabolically-shaped reflecting segments concentric with and surrounding said central circular planar area, each of said plurality of annular parabolically-shaped reflecting segments being arranged to have an associated focal point that is different from the associated focal point of each other one of said plurality of parabolically-shaped relecting segments;

a base member removably connected to said dish-shaped member for supporting said circular dish-shaped member in a particular orientation, said base member comprising a U-shaped support extending from a pair of points on a peripheral edge of said dish-shaped member in an area behind said inner concave surface of said circular dish-shaped member;

elevation adjustment means removably connected to said circular dish-shaped member and to said base member for setting an elevation angle of said circular dish-shaped member; and feed mount means removably connected to a peripheral edge of said circular dish-shaped member for supporting a feed horn and amplifier assembly in a fixed position in front of said inner concave surface of said circular dish-shaped member.

2. A satellite dish antenna system as in claim 1 wherein:

said circular dish-shaped member includes a pair of upwardly extending feed mount receptacles of rectangular cross section attached along a peripheral edge of said circular dish-shaped member; and said feed mount means comprises a fork-shaped frame having a pair of downwardly projecting fork members of rectangular cross section removably mating with said feed mount receptacles.

3. A satellite dish antenna system as in claim 1 wherein said elevation adjustment means comprises telescoping rod means and securing means for setting a desired overall length of said telescoping rod means.

4. A satellite dish antenna system comprising:

a circular dish-shaped member having an inner concave reflecting surface to be focused toward a transmitting earth satellite, the inner concave reflecting surface of said circular dish-shaped member having a central circular planar area and a plurality of annular parabolically-shaped reflecting segments concentric with and surrounding said central circular planar area, each of said plurality of annular parabolically-shaped reflecting segments being arranged to have an associated focal point that is different from the associated focal point of each other one of said plurality of parabolically-shaped reflecting segments, said dish-shaped member including a circular lip formed along a peripheral edge thereof behind said inner concave surface;

a base member comprising a single circular ring having a diameter substantially equal to a diameter of said circular dish-shaped member, said single circular ring being hingedly attached to said dish-shaped member for motion between an operating position supporting said dish-shaped member at a desired angle of elevation and a stowed position within said circular lip of said dish-shaped member;

elevation adjustment means removably connected to said circular dish-shaped member and to said base member for setting an elevation angle of said circular dish-shaped member; and feed mount means removably connected to a peripheral edge of said circular dish-shaped member for supporting a feed horn and amplifier assembly in a fixed position in front of said inner concave surface of said circular dish-shaped member.

* * * * *